US006631681B2

(12) United States Patent
Franke et al.

(10) Patent No.: US 6,631,681 B2
(45) Date of Patent: Oct. 14, 2003

(54) PRINTING MACHINE WITH OBSERVATION WINDOW AND WITH CONTROL AND/OR DISPLAY ELEMENTS DISPOSED IN THE VICINITY THEREOF

(75) Inventors: Volkhard Franke, Heidelberg (DE); Eckhard Köbler, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/817,962

(22) Filed: Mar. 27, 2001

(65) Prior Publication Data

US 2001/0029864 A1 Oct. 18, 2001

(30) Foreign Application Priority Data

Mar. 27, 2000 (DE) ..... 100 15 169

(51) Int. Cl.[7] ..... B41F 33/02
(52) U.S. Cl. ..... 101/480; 101/494
(58) Field of Search ..... 101/480, 494

(56) References Cited

U.S. PATENT DOCUMENTS 3,762,320 A * 10/1973 Johne et al. ..... 101/183
4,812,842 A 3/1989 Bayerlein et al.
5,128,659 A * 7/1992 Roberts et al. ..... 340/980
5,540,152 A * 7/1996 DeMoore ..... 101/240
6,121,960 A * 9/2000 Carroll et al. ..... 345/169
6,240,347 B1 * 5/2001 Everhart et al. ..... 367/197
6,373,472 B1 * 4/2002 Palalau et al. ..... 345/156

FOREIGN PATENT DOCUMENTS

GB 2 275 445 A 8/1984
GB 2 275 444 B 8/1994

* cited by examiner

*Primary Examiner*—Daniel J. Colilla
*Assistant Examiner*—Jill E. Culler
(74) *Attorney, Agent, or Firm*—Laurence A. Greenberg; Werner H. Stemer; Ralph E. Locher

(57) ABSTRACT

A printing machine includes an observation window, and at least one element selected from the groups consisting of control elements and display elements disposed in the vicinity of the observation window, the at least one of the control and display elements being disposed in the observation window so that, at least in part, it is possible to see a product of the printing machine through the window.

9 Claims, 2 Drawing Sheets

PRINTING MACHINE WITH OBSERVATION WINDOW AND WITH CONTROL AND/OR DISPLAY ELEMENTS DISPOSED IN THE VICINITY THEREOF

BACKGROUND OF THE INVENTION

Field of the Invention

The invention relates to a printing machine with an observation window and with control and/or display elements disposed in the vicinity of the observation window. The sheet deposition and stacking process can be observed through the observation window, when the printing machine brings its product to the delivery and deposits the sheets thereat. In order to detect process fluctuations in the newest sheet and to correct them as quickly as possible, a plurality of control and/or display elements are generally placed around this delivery window.

A disadvantage here is that there are so many displays and inputs of information that it is impossible to observe both the printed product and the machine information simultaneously. Furthermore, it takes considerable practice to be able to input events or commands into the printing machine while simultaneously observing the delivery, because the control elements sometimes have to be operated partly in the blind due to spatial considerations. Often, again due to spatial considerations, not all of the control functions are located in the delivery, so that the entire machine is settable only from a control stand, which results in time and production losses, especially in the phase wherein the correct settings of the machines would have to be found.

From the published German Patent Document DE 36 14 744 C2, it has become known to provide the pressman personally with a remote control device. A disadvantage thereof is that the pressman sees the machine data on a rather small display and hence not adequately comprehensively.

SUMMARY OF THE INVENTION

It is accordingly an object of the invention to provide a printing machine with an observation window and with control and/or display elements in the vicinity of the observation window, which enables the pressman to observe the printed products in the delivery and to perform the setting of the machine without any marked loss of visibility or time.

With the foregoing and other objects in view, there provided, in accordance with the invention, a printing machine comprising an observation window, and at least one element selected from the groups consisting of control elements and display elements disposed in the vicinity of the observation window, the at least one of the control and display elements being disposed in the observation window so that, at least in part, it is possible to see a product of the printing machine through the window.

In accordance with another feature of the invention, the at least one element displayed in the observation window is located in a first focal region/image plane, and the product visible through the observation window is located in a second focal region/stacking plane.

In accordance with a further feature of the invention, a position-sensitive input device is disposed in the vicinity of the observation window, and a given significance content dependent upon the display of a switch element is to be assigned to a given position in the observation window.

In accordance with an added feature of the invention, all of the control elements required for the printing machine can be operated exclusively via the observation window.

In accordance with an additional feature of the invention, the display elements and the control elements are represented as at least one of the groups consisting of numerical values, writing and graphics.

In accordance with yet another feature of the invention, the display elements and the control elements are represented at least one of in part statically and in motion, respectively, in at least one color and in from one to three dimensions.

In accordance with yet a further feature of the invention, a hierarchical data structure (menu) with images expandable to various logical planes, is representable in the observation window.

In accordance with yet an added feature of the invention, the printing machine includes two product piles present in a delivery region for the printing machine.

In accordance with a concomitant feature of the invention, the printing machine includes a product pile and a sample sheet stacking capability present in a delivery region for the printing machine.

Thus, the control and/or display elements are disposed on the observation window in a way that at least in part makes it possible to see a product of the printing machine. As a result, the observation window present in the delivery region is used as a display field and gives the pressman the capability of having the printed sheets in view. The data required by the pressman can be projected onto the observation window, and the observation window remains transparent enough so that it can assuredly be seen through. Instead of or together with the machine data, control elements can also be provided, which make an input possible for controlling the printing operations.

By the dual use of the observation window in the feeder and/or delivery region, a separate free-standing control pedestal is unnecessary, which offers advantages in terms of compactness of the floor space, transportation, and electronics, because the control and/or display elements are parts of the machines themselves.

Advantageously, the display and/or control elements displayed in the observation window are located in a first focal plane, and the product visible through the observation window is located in a second focal plane. By successively adjusting the focal plane, the operator can observe both sets of information in the same field of view and make adjustments if necessary or desirable. The second plane can be located anywhere behind the observation window; i.e., when the operator is viewing the front edge of the pile towards the observation window, the second focal plane is located immediately behind the observation window, but if he is looking at the rear edge of the pile, the focal plane is then located far behind the observation window.

In a further feature, a position-sensitive input device is disposed in the vicinity of the observation window, and a given significance content dependent upon the display of a switch element is to be assigned to a given position in the observation window. The position-sensitive input device can be constructed as pressure-sensitive and/or light-sensitive. Advantageously, the display elements displayed on the observation window are located on the rear side of the observation window, and the position-sensitive input device is located on the front side of the observation window, so that both are perceptible to the user at least approximately in a single, first focal plane.

Position-sensitive screens have become known heretofore as such, but their use is always in conjunction with a nontransparent screen.

Advantageously, all the control elements required for the printing machine can be operated exclusively via the observation window. This maximally avoids time losses in setting the printing machine.

The display and/or control elements can be represented as numerical values, writing and/or graphics, and furthermore also are shown at least in part statically or in motion, in one or more colors and in one to three dimensions.

Advantageously, a hierarchical data structure (menu) can be shown in the observation window, and in control events for individual control elements, total images can be expanded and newly shown on different logical planes.

It is especially advantageous if the printing machine has two product piles, or one product pile and one sample sheet stacking capability in the delivery region, because in such a case even relatively difficult assessment criteria, such as color calibration ink zone setting or key adjustment, can be evaluated at leisure and set directly at the printing machine.

Other features which are considered as characteristic for the invention are set forth in the appended claims.

Although the invention is illustrated and described herein as embodied in a printing machine with an observation window and with control and/or display elements disposed in vicinity of the observation window, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
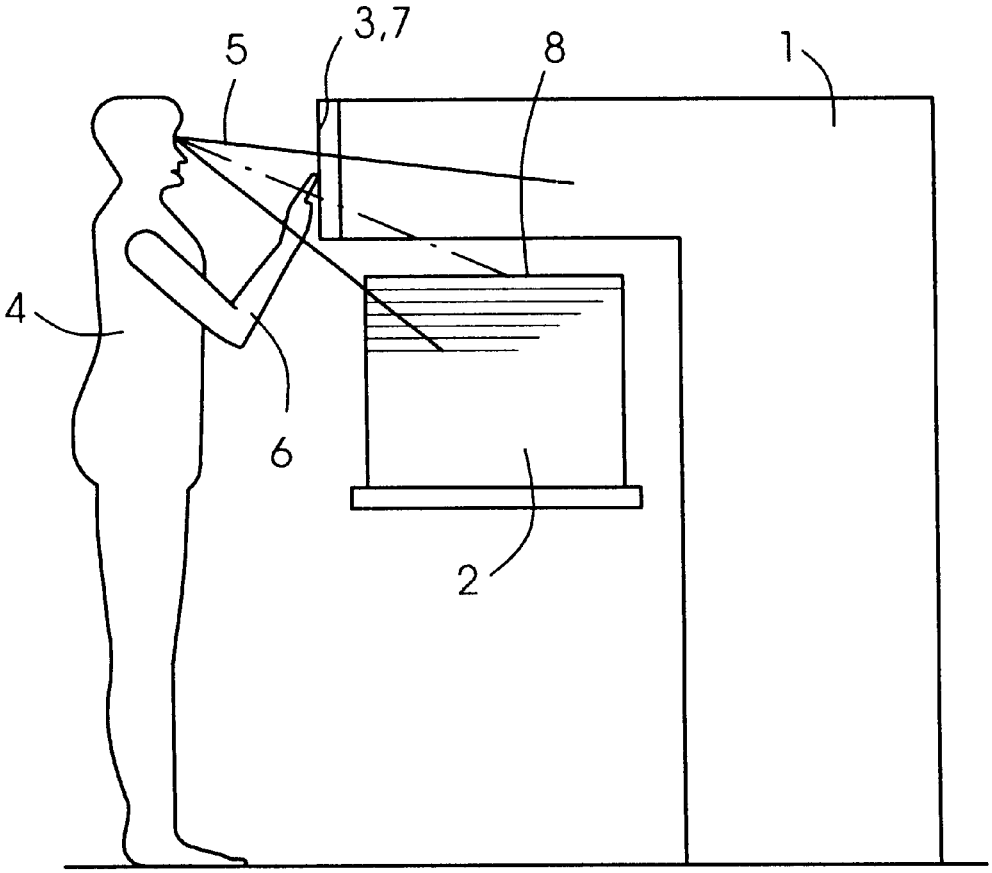
FIG. 1 is a diagrammatic side elevational view of a printing machine with an observation window, and including an operator looking through the observation window.

Referring now to the drawings and, first, particularly to FIG. 1 thereof, there is shown diagrammatically therein a delivery of a printing machine 1, to which sheets are brought and deposited, creating a sheet pile 2. The deposition and stacking operation associated therewith can be observed through an observation window 3 by an operator 4. In this regard, it is possible for the operator 4 to look through the observation window 3, in order to see the sheet pile 2 within his or her field of view 5. If the printing machine is of the type having two paper piles or stacks in the delivery region, and having a sample sheet deposition capability, respectively, even relatively difficult assessment criteria can then be evaluated through the observation window quite leisurely and set directly at the printing machine, an example being color calibration inking zone setting or key adjustment.

Moreover, the operator 4, by moving his or her arm 6 or only his or her hand, can also have an effect upon control elements disposed in the vicinity of the observation window 3, in order to control the printing machine. The observation window 3 can be embodied as a type of touch screen, with a network of rays in front of or in the plane of the screen, for ascertaining a coordinate when the network of rays is disturbed by some element, such as a finger. From the coordinate that is ascertained, the key function is tripped and controlled, respectively, on the screen with like coordinates. In an observation window embodied in this manner, the display itself is connected to the operating function of keys.

Figure 3:
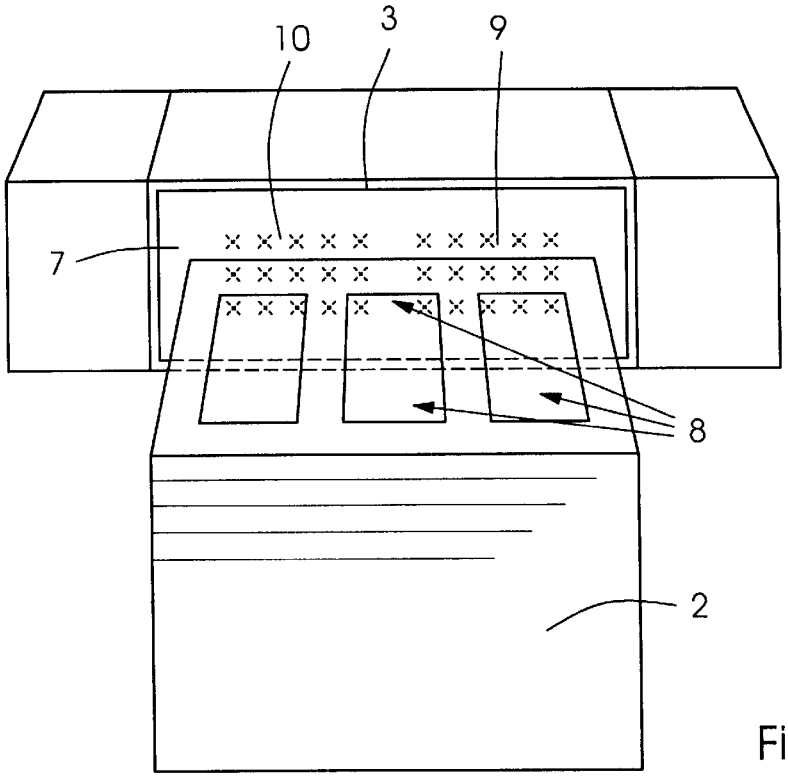

As an alternative or in addition thereto, it is possible for display elements, which are perceived visibly at depth in the image, to be reflected into the observation window; this is known as a head-up display (note FIG. 3).

Accordingly, the technical realization of the observation window follows the head-up display, and transparent monitors and liquid crystal displays, respectively.

The control and/or display elements are shown in a first focal region/image plane 7; the surface of the paper stack or pile 2 can be perceived as a focal region/stack or pile plane 8 of relatively great size. The focal region/image plane 7 and the focal region/stack or pile plane 8 are selected so that they do not overlap at any time.

Figure 2:
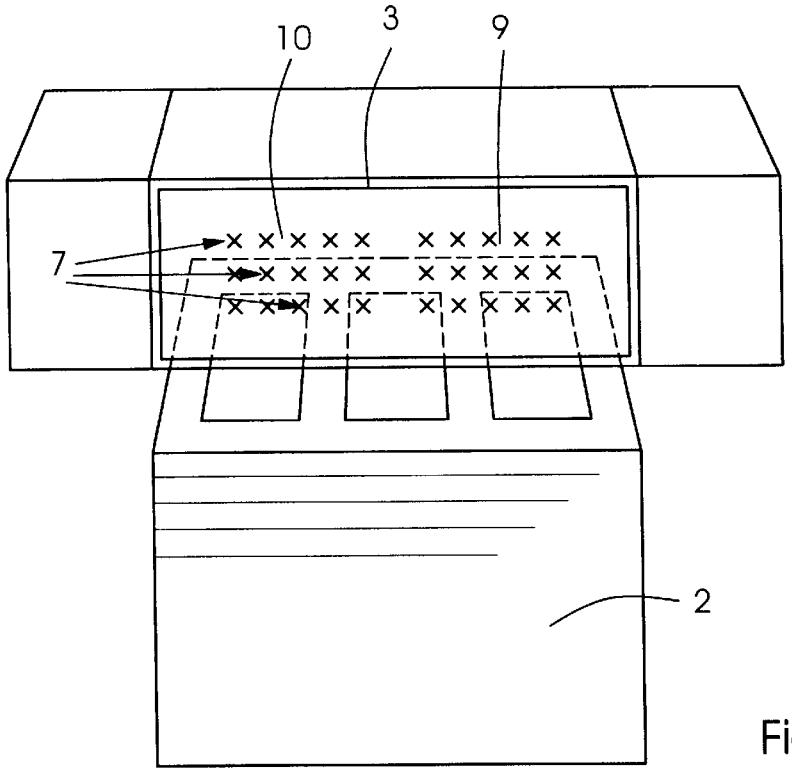
FIGS. 2 and 3 are diagrammatic front elevational views of the printing machine, with control and/or display elements shown through the observation window, together with printed products, illustrating the touch-screen and Head-up display types for the observation windows, respectively.

FIG. 2 is a view of the observation window 3 in the first focal region/image plane 7. In this regard, the surface of the pile or stack 2 can be seen in the background, and the display elements 9 and control elements 10 disposed in the first focal region/image plane 7 can be seen in a portion of the observation window 3. The display elements 9 shown on the observation window 3 are located on the rear side of the observation window 3, while the position-sensitive input elements 10 are located on the front side of the observation window 3, so that both the display and input elements 9 and 10 can be perceived by the operator at least approximately in a single first focal plane, namely the plane of the observation window 3. The observation window 3 can be embodied in multiple layers, and the display elements can be disposed in one of these layers.

The second focal plane according to FIG. 3 can be located anywhere behind the observation window, i.e., if the operator is looking at the front edge of the stack or pile 2 directed towards the observation window 3, the second focal plane is then located immediately behind the observation window 3, but if he is looking at the rear edge of the stack or pile 2, the second focal plane is then located far behind the observation window 3. The focal plane can be recognized in that the regions which lie in the focus are illustrated with continuous lines whereas the regions which do not lie in the focal plane are illustrated with dashed lines.

By successively adjusting the focal plane, the operator can observe both sets of information in the same field of view and can make desirable or necessary adjustments.

We claim:

1. A printing machine comprising an observation window, and control elements and display elements disposed in the vicinity of said observation window, said control elements and said display elements being disposed in said observation window so that, at least in part, it is possible to see a product of the printing machine through said observation window.

2. The printing machine according to claim 1, wherein said control elements and said display elements displayed in said observation window are located in a first focal region/image plane, and the product visible through the observation window is located in a second focal region/stacking plane.

3. The printing machine according to claim 1, wherein a position-sensitive input device having a display is disposed in the vicinity of said observation window, said input device is a switch element disposed at a specific position, and said switch element has a significance content dependent upon said display of said input device.

4. The printing machine according to claim 1, wherein all of said control elements required for the printing machine can be operated exclusively via said observation window.

5. The printing machine according to claim 1, wherein said display elements and said control elements are represented as at least one of the groups consisting of numerical values, writing and graphics.

6. The printing machine according to claim 1, wherein said display elements and said control elements are represented at least one of in part statically and in motion, respectively, in at least one color and in from one to three dimensions.

7. The printing machine according to claim 1, wherein a hierarchical data structure with images expandable to various logical planes, is representable in said observation window.

8. The printing machine according to claim 1, including two product piles being present in a delivery region for the printing machine.

9. The printing machine according to claim 1, including a product pile and a sample sheet stacking capability being present in a delivery region for the printing machine.

* * * * *